US005897325A

United States Patent [19]

Koby-Olson

[11] Patent Number: 5,897,325

[45] Date of Patent: Apr. 27, 1999

[54] THINKING-LEARNING-CREATING CUBICLE AND METHOD FOR USE

[76] Inventor: Karen S. Koby-Olson, 3068 Wilkinson Rd., Gaylord, Mich. 49735

[21] Appl. No.: 08/954,194

[22] Filed: Oct. 20, 1997

[51] Int. Cl.[6] ..... A47B 39/00

[52] U.S. Cl. ..... 434/432; 52/79.1; 52/239; 434/236; 434/365; 434/258

[58] Field of Search ..... 434/432, 29, 62, 434/65, 69, 236, 258, 369; 52/79.1, 239

[56] References Cited

U.S. PATENT DOCUMENTS

| | | | |
|---|---|---|---|
| 3,283,418 | 11/1966 | Brewer et al. | 434/29 |
| 3,542,934 | 11/1970 | Warhurst et al. | 35/10.2 |
| 3,694,933 | 10/1972 | Busch | 434/432 |
| 4,026,038 | 5/1977 | Sunter et al. | 35/10.2 |
| 4,486,180 | 12/1984 | Riley | 434/65 |
| 4,538,995 | 9/1985 | Fryer | 434/432 |
| 5,030,253 | 7/1991 | Tokuhiro et al. | 55/89 |
| 5,222,894 | 6/1993 | Cabana | 434/29 |
| 5,316,480 | 5/1994 | Ellsworth | 434/29 |
| 5,416,931 | 5/1995 | Wolfenden et al. | 4/524 |
| 5,429,432 | 7/1995 | Johnson | 312/253.3 |
| 5,490,784 | 2/1996 | Carmein | 434/55 |
| 5,567,164 | 10/1996 | Durkin et al. | 434/432 |

FOREIGN PATENT DOCUMENTS

| | | | |
|---|---|---|---|
| 2544259 | 4/1977 | Germany | 52/79.1 |
| 2-49862 | 2/1990 | Japan | 52/79.1 |

*Primary Examiner*—Robert A. Hafer
*Assistant Examiner*—Michael B. Priddy
*Attorney, Agent, or Firm*—Gifford, Krass, Groh, Sprinkle, Anderson & Citkowski, P.C.

[57] ABSTRACT

A method for developing cognitive and motor skills in students comprising the steps of providing a thinking-learning-creating cubicle having a plurality of walls forming an enclosed space. The walls are operative to substantially prevent visual and auditory stimuli from sources disposed exteriorly of the walls from penetrating the enclosed space, thereby reducing distractions to a student positioned within the enclosed space. A learning interface in electrical communication with an interactive teaching apparatus is disposed within the enclosed space which is configured to direct the student's attention toward the learning interface. Communication means are provided which permit communication between an individual positioned within the enclosed space and an individual positioned exteriorly of the enclosed space. The method also includes the step of selecting a learning task for a student to execute within the enclosed space. A student disposed within the enclosed space executes the selected learning task and the student's progress in executing the task is monitored.

7 Claims, 2 Drawing Sheets

THINKING-LEARNING-CREATING CUBICLE AND METHOD FOR USE

FIELD OF THE INVENTION

The present invention relates generally to methods for developing skills in students with special needs and more particularly to methods for developing skills in such students utilizing a thinking-learning-creating cubicle.

BACKGROUND OF THE INVENTION

The learning environment present in most public and private schools is structured to teach a predetermined amount of material within a given time to the average student who learns well in a group environment and socializes easily with his or her classmates. Unfortunately, many students with special needs such as very bright students do not learn well in a group environment or have learning difficulties such as attention deficit disorder (ADD) or attention deficit hyperactivity disorder (ADHD) which prohibit them from learning at the level at which they are capable. These students are easily distracted from their learning tasks by auditory and visual stimuli within the learning environment. Such auditory and visual stimuli include movement and talking of classmates, people passing by the classroom door, an inclass heater turning on, or activities seen or heard through a classroom window. While teachers may attempt to reduce the distractions to a student by carefully selecting their seating position within the room, these distractions remain a significant problem for such students. Some students learn at a pace faster than their peers or have an inability to focus on tasks for the length of time required to teach a large number of students. Alternately, select students need particularized repetition in a single mode, such as those students who learn better using one sense or another, such as those students who learn primarily by hearing and who greatly benefit from listening to a lesson repeatedly.

Due to the large number of students which must be taught in each classroom and the time constraints, teachers are unable to structure and provide special lessons which are appropriate for these students. The number of people who fail to complete grammar or high school despite their high intelligence are numerous and well known. Thus, it is apparent that the learning environment in most schools possesses insufficient flexibility to accommodate these "special needs" children as the traditional learning environment cannot be easily "custom fit" to teach each child in the fashion which is most effective for them.

There exist a variety of substitutes for the typical learning environment for those children who cannot function appropriately or learn at their level within the environment provided by most public and private schools. Home schooling of children by parents is a fast growing phenomenon which is gaining popularity in the United States. Many parents choose home schooling because their children have not performed well in the traditional classroom environment for a variety of reasons. Another substitute for the typical learning environment which is provided by public and private schools include special educational programs or special classes within the same facilities which offer the traditional learning classes. Unfortunately, these special classes isolate children from their peers and these children fail to learn appropriate socialization skills. Such children are often labeled as "different" and are ostracized by their peers.

The disadvantages of these substitutes for the typical learning environment are numerous and include increased expense as well as potential socialization problems for the children. The level of learning which is accomplished by these students in selected substitutes for the typical learning environment is uncertain.

Thus, by increasing the flexibility of the traditional learning environment to accommodate these special children, these children may avoid the negative social stigma without sacrificing their education or posing significant financial constraints on parents or schools.

SUMMARY OF THE INVENTION

The present invention is directed to a method for developing cognitive and motor skills in a special needs student comprising the steps of providing a learning cubicle having a plurality of walls forming an enclosed space. The enclosed space is sufficiently large so as to permit at least one individual to stand upright within the enclosed space. The walls are operative to reduce distractions within the enclosed space by preventing visual and auditory stimuli from sources disposed exteriorly of the walls from penetrating the enclosed space. At least one seat is disposed within the enclosed space. A door allowing access to the enclosed space is provided, the door in its closed position being operative to substantially prevent visual and auditory stimuli from sources disposed exteriorly of the enclosed space from penetrating the enclosed space.

A learning interface such as a computer terminal including a monitor and a keyboard or a television and video cassette recorder is disposed within the enclosed space. The learning interface is in electrical communication with an interactive teaching apparatus such as a microprocessor or other learning system. The interactive teaching apparatus may be a centralized microprocessor which is in electrical communication with a plurality of learning interfaces remotely located from the microprocessor. Alternately, the learning interface and the interactive teaching apparatus may comprise a microprocessor, keyboard and monitor all positioned within the enclosed space.

The enclosed space is configured to direct the student's attention toward the learning interface. Means for providing a controllable level of illumination within the enclosed space are provided, and preferably include a plurality of lights and a dimmer switch in electrical communication with the lights. A high intensity light may be provided for students whose special needs arise from seasonal affective disorder.

Means for selectively dispensing an aroma are preferably provided and, in the preferred embodiment, include an atomizer. Means for ventilating the enclosed space are also provided and preferably include a ventilating fan.

Communication means are provided which are operable to permit communication between a student within the enclosed space and an individual such as a teacher positioned exteriorly of the learning cubicle. In the preferred embodiment, an intercom and speaker are utilized although alternate embodiments may include a series of indicating lights positioned both within the enclosed space and exteriorly of the learning cubicle. The communication means are preferably configured to be activated by either the student or the teacher.

After the learning cubicle has been provided, the next step in the method includes selecting a learning task for a student to perform within the enclosed space. A student is disposed within the enclosed space and executes the selected learning task. The progress of the student is monitored during the execution of the task. Other objects, advantages and applications of the present invention will be made clear by the following detailed description of a preferred embodiment of the invention. The description makes references to drawings in which:

DETAILED DESCRIPTION

The present invention is a method for developing cognitive and motor skills in a student having special needs such as high intelligence, ADD/ADHD, seasonal affective disorder or other conditions which make learning in the traditional school environment difficult. The method comprises the steps of providing a learning cubicle described in detail hereinbelow. A learning task is selected for the student to perform within the learning cubicle by a teacher, aide or the student. The student is disposed within the cubicle and executes the selected learning task. The student's progress in executing the task is monitored by a teacher, aide or the like.

Figure 1:
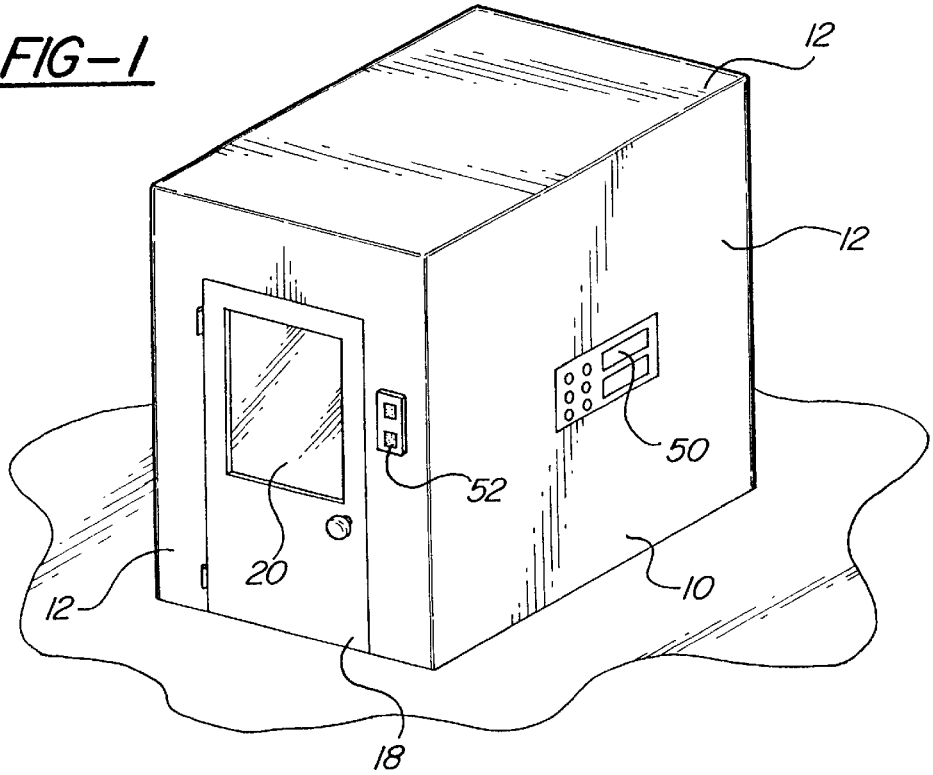
FIG. 1 is a perspective view of the exterior of the learning cubicle of the present invention.
Figure 3:
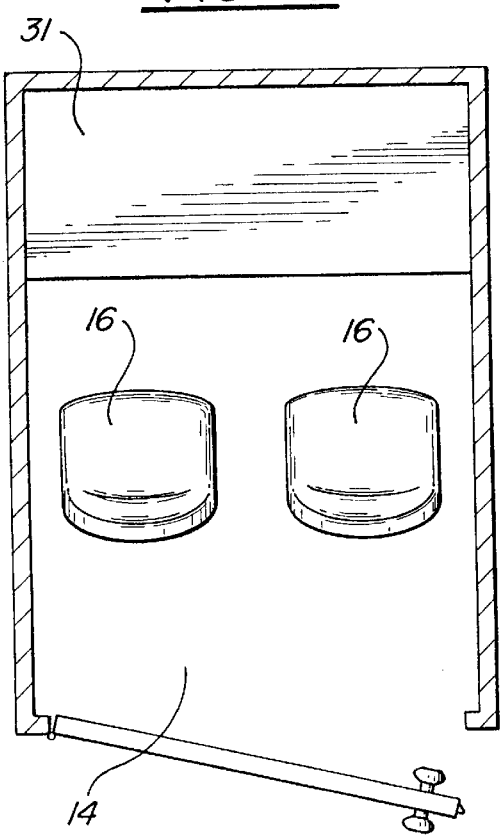
FIG. 3 is a top view of the enclosed space within the learning cubicle.
Figure 4:
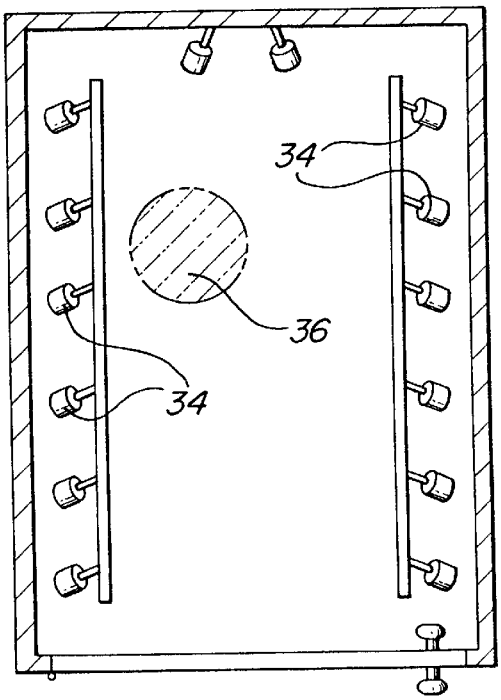
FIG. 4 is a view of the uppermost portion of the enclosed space within the learning cubicle.
Figure 2:
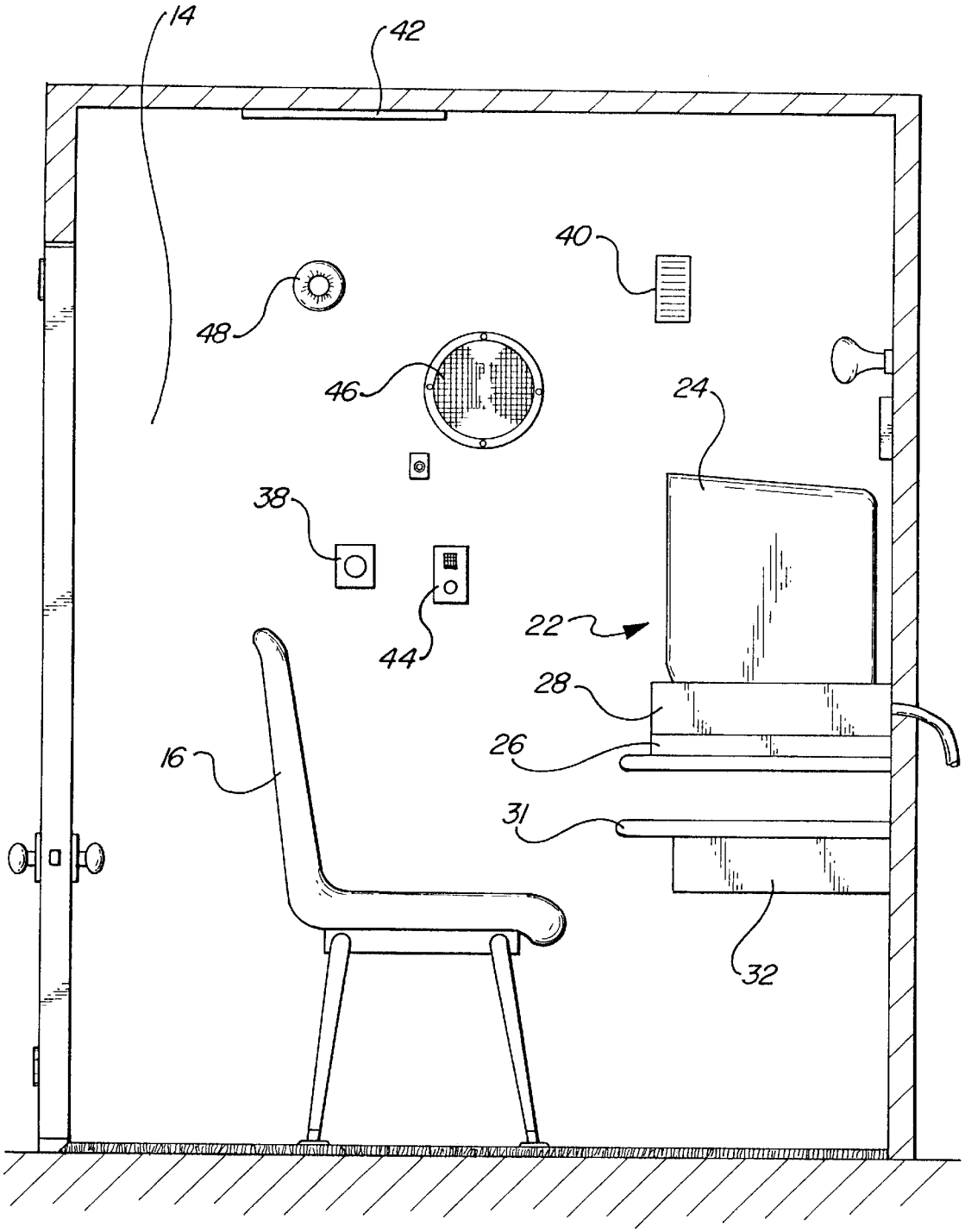
FIG. 2 is a side view of the enclosed space within the learning cubicle.

The learning cubicle 10, shown in FIG. 1, includes a plurality of walls 12 which form an enclosed space 14, best seen in FIG. 2. The enclosed space 14 is sufficiently large so as to permit at least one student and preferably a student and a teacher to stand upright within the enclosed space 14. The walls 12 are operative to reduce distractions within the enclosed space by preventing visual and auditory stimuli from sources disposed exteriorly of the walls 12 from penetrating the enclosed space 14. In the preferred embodiment, the walls 12 are opaque and have placed, on the side disposed within the enclosed space 14, a soft covering which assists in absorbing sound. The walls 12 may be variously configured and may be structured so as to be easily assembled, relocated and reassembled.

At least one seat 16 is disposed within the enclosed space 14 and is suitable for supporting a student or teacher. The seat may be a swing-out stool attached to one of the walls 12, a chair or the like.

The walls 12 of the learning cubicle may be structured to permit a plurality of such learning cubicles to be assembled in a side by side fashion, thereby achieving cost efficiencies.

A door 18 is formed in the walls 12 which allows access to the enclosed space 14. The door 18, in its closed position, is operative to reduce distractions within the enclosed space 14 by preventing visual and auditory stimuli from sources disposed exteriorly of the enclosed space 14 from penetrating the enclosed space. In a preferred embodiment, a panel of one-way glass 20 is disposed within the door to allow a teacher or supervisor to view the student within the learning cubicle without permitting visual and auditory stimuli from entering the enclosed space and disturbing the student.

A learning interface 22 is disposed within the enclosed space, and in the preferred embodiment includes a computer terminal having a monitor 24 and keyboard 26. In the alternate embodiments, a television may be utilized as the learning interface. The learning interface 22 is preferably in electrical communication with an interactive teaching apparatus such as a microprocessor 28. Alternately, a video cassette recorder may be utilized, the student being able to start, stop and rewind the lesson so that they may repeat portions of the lesson. The microprocessor may be positioned within the enclosed space 14 or may be disposed exteriorly of the learning cubicle 10. For example, the monitor 24 and keyboard 26 may be in electrical communication with a centralized microprocessor through which a plurality of such learning interfaces 22 may be controlled. Such a network of learning interfaces are commonly used in learning environments where a centralized storage and control of teaching materials is desired. The teacher, aide or the like may select a task for the student to complete remotely or by operating the learning interface.

An almost limitless number of learning tasks maybe accomplished in such a cubicle. In particular, any learning task which may be performed on a computer terminal or which is suitable for completion within the enclosed space 14 may be selected to be performed by the student. The student may also take tests or perform other tasks related to learning within the enclosed space.

Additionally, a computerized learning task may be operative to enable a teacher, aide or the like to monitor the student's progress during execution of the task. For example, the computer may send a signal to the teacher when a student completes a selected number of steps in the task or fails to accomplish a selected task within a selected time. The learning interface 22 may include software which enables the student to send and receive messages from a terminal or other similar device located proximate to the teacher.

The enclosed space 14 is configured to direct the student's attention toward the learning interface so that students who have difficulty focusing their attention for a significant period of time are assisted by the configuration of the interior walls and other elements positioned within the enclosed space 14.

The learning interface is preferably positioned on the desk 31 or other horizontal work surface within the enclosed space 14. Additional storage 32 may be provided for other equipment such as musical instruments, tape recorders or other equipment which the student may need to complete a task. This enables students to complete their tasks without leaving the enclosed space 14. Preferably, the storage 32 prohibits the student from viewing the contents disposed therein, thus reducing the extraneous stimuli which may distract the student from completion of the learning task.

Means for providing a controllable level of illumination within the enclosed space are provided and, in the preferred embodiment, include a plurality of lights 34 in electrical communication with a dimmer switch 38. This enables the level of illumination to be controlled by the student positioned within the enclosed space. The dimmer switch 38 may alternately be positioned exteriorly of the enclosed space so that an individual such as a teacher who is not within the enclosed space may control the level of illumination. In an alternate embodiment, a high intensity light 36 may be provided, such a high intensity light being particularly suitable for helping students with seasonal affective disorder to complete their tasks. Additionally, it is preferred that the intensity light 36 be controlled with a dimmer switch or other suitable means.

Selected students may benefit from working in an environment which is predominated by a particular color. This effect may be achieved within the enclosed space 14 by utilizing colored lights. Such colored lights may also be utilized in conjunction with colored sliding panels which may be placed over the interior of the walls 12. Preferably, such sliding panels resemble window shades of the type which are rolled onto a rod. The sliding panels being manufactured using similar technology. Such sliding panels may be positioned proximate to the upper end of the enclosed space and drawn downward to cover the walls sufficiently so as to provide an environment within which such color dominates. The effect may be modified with the amount of white light provided within the enclosed space. Alternate methods and structures may be utilized to vary the predominant color scheme within the enclosed space 14, thus providing a working environment which may assist students whose special needs may be addressed by a color change in the environment within which they are working.

Means for selectively dispensing an aroma within the enclosed space 14 are preferably provided and include an atomizer 40. The atomizer 40 emits a scent which is intended to have a particular effect on the student positioned within the booth. For example, lavender is known to have a calming effect on individuals while peppermint has a stimulating effect on individuals. The ventilation fan 42 may be utilized to quickly eliminate such scents from the enclosed space 14 so that a subsequent student is not affected by the aroma utilized to enhance the performance of the previous student.

Communication means are provided in the present invention which permit communication between an individual positioned within the enclosed space 14 and an individual positioned exteriorly of the enclosed space 14. Such communication means enables a teacher, aide or the like to monitor the student's progress during the execution of the learning task. The communication means may be auditory via an intercom 44 and speaker 46 or through a series of lights 52. For example, red and green lights may be utilized to indicate that the student needs help, has completed the task or requests that an interior condition such as lighting or temperature be adjusted.

The speaker 46 may be utilized to introduce music into the enclosed space. The music may be used for a variety of purposes, including soothing, teaching and the like. Earphones and other controls such as volume may also be provided to enable the student to listen to the music without disturbing those outside of the enclosed space.

A timer 48 is preferably provided, the timer including a clock and bell to signal when the student's time for completion of the task is nearly complete and when the time for completion of the task has expired.

The elements within the enclosed space 14 may be variously positioned to meet the special needs of individual students. Controls which are positioned interiorly or exteriorly of the learning cubicle may be moved to other positions more convenient for a particularized application of the learning cubicle.

Having described the various embodiments of the present invention with reference to the accompanying figures, it will be appreciated that various changes and modifications can be made without departing from the scope or spirit of the invention.

I claim:

1. A method for developing cognitive and motor skills in a plurality of students comprising the steps of:

I. providing a plurality of learning cubicles, each learning cubicle having

A. a plurality of walls forming an enclosed space sufficiently large so as to permit at least one individual to stand upright within the enclosed space, the walls operative to substantially prevent visual and auditory stimuli from sources disposed exteriorly of the walls from penetrating the enclosed space so as to reduce distractions within the enclosed space the walls of the learning cubicle having a color associated therewith, B. a seat disposed within the enclosed space, C. a door allowing access to the enclosed space, the door, in its closed position, operative to substantially prevent visual and auditory stimuli from sources disposed exteriorly of the enclosed space from penetrating the enclosed space, D. a learning interface disposed within the enclosed space, the interface being in electrical communication with an interactive teaching apparatus, the enclosed space being configured to direct the student's attention toward the learning interface, E. means for providing a controllable level of illumination within the enclosed space, F. means for selectively dispensing an aroma within the enclosed space, G. means for ventilating the enclosed space, H. communication means operable to permit communication between an individual positioned within the enclosed space and an individual positioned exteriorly of the enclosed space; and I. means for selectively and non-permanently changing the color of at least a portion of the cubicle walls to one or more additional colors, II. selecting a learning task for each student to execute within one of the enclosed spaces, III. disposing one of the students within each enclosed space;

IV. each student executing their selected learning task,

V. monitoring each student's progress in executing their task

VI. adjusting the level of illumination, selecting and dispensing an aroma, and selecting a color for the walls for each of the cubicles so as to optimize the learning environment for the student within each enclosed space.

2. The method of claim 1 wherein the step of selecting a learning task includes the step of selecting a learning task for the student to execute in the learning interface.

3. The method of claim 1 wherein the step of providing a cubicle includes the step of providing a cubicle having the interactive teaching apparatus disposed within the enclosed space.

4. The method of claim 1 wherein the step of monitoring the student's progress in executing the task includes the step of sending a signal to the learning interface from the interactive teaching apparatus.

5. A learning cubicle for providing an isolated learning environment for a student to enhance a learning process, said learning cubicle comprising:

a plurality of walls forming an enclosed space sufficiently large so as to permit at least one individual to stand upright within the enclosed space, the walls operative to substantially prevent visual and auditory stimuli from sources disposed exteriorly of the walls from penetrating into the enclosed space, said walls having a color associated therewith;

means for selectively and non-permanently changing the color of at least a portion of said walls to a one or more additional colors;

a seat disposed within the enclosed space;

a door disposed in one of said plurality of walls and allowing access to the enclosed space, the door, in a closed position, operative to substantially prevent visual and auditory stimuli from sources disposed exteriorly of the enclosed space from penetrating into the enclosed space;

a learning interface disposed within the enclosed space for operation by the student, the enclosed space being configured to direct the student's attention toward the learning interface;

an interactive teaching apparatus in electrical communication with the learning interface;

means for providing a controllable level of illumination within the enclosed space;

means for selectively dispensing an aroma within the enclosed space;

means for ventilating the enclosed space; and communication means operable to permit communication between an individual positioned within the enclosed space and an individual positioned exteriorly of the enclosed space.

6. A learning cubicle according to claim 5, further comprising a work surface disposed within the enclosed space, said learning interface being disposed on said work surface.

7. A method for developing cognitive and motor skills in a student comprising the steps of:

I. providing a learning cubicle having

A. a plurality of walls forming an enclosed space sufficiently large so as to permit at least one individual to stand upright within the enclosed space, the walls operative to substantially prevent visual and auditory stimuli from sources disposed exteriorly of the walls from penetrating the enclosed space so as to reduce distractions within the enclosed space, B. a seat disposed within the enclosed space, C. a door allowing access to the enclosed space, the door, in its closed position, operative to substantially prevent visual and auditory stimuli from sources disposed exteriorly of the enclosed space from penetrating the enclosed space, D. a learning interface disposed within the enclosed space, the interface being in electrical communication with an interactive teaching apparatus, the enclosed space being configured to direct the student's attention toward the learning interface, E. means for providing a controllable level of illumination within the enclosed space, F. means for selectively dispensing an aroma within the enclosed space, G. means for ventilating the enclosed space, H. communication means operable to permit communication between an individual positioned within the enclosed space and an individual positioned exteriorly of the enclosed space; and I. means for selectively and non-permanently changing the color of at least a portion of the cubicle walls to one or more additional colors, II. selecting a learning task for a student to execute within the enclosed space, III. disposing the student within the enclosed space;

IV. the student executing their selected learning task,

V. monitoring the student's progress in executing their task

VI adjusting the level of illumination, selecting and dispensing an aroma, and selecting a color for the walls for each of the cubicles so as to optimize the learning environment for the student within the enclosed space.

* * * * *